United States Patent [19]

Stillfried et al.

[11] Patent Number: 4,493,244

[45] Date of Patent: Jan. 15, 1985

[54] PNEUMATIC DOOR OPERATOR

[75] Inventors: Rüdiger F. V. Stillfried, Barsinghausen, Fed. Rep. of Germany; Günter Seegers, West Bloomfield, Mich.; Günter Sebesta, Hemmingen, Fed. Rep. of Germany

[73] Assignee: WABCO Fahrzeugbremsen GmbH, Hanover, Fed. Rep. of Germany

[21] Appl. No.: 386,550

[22] Filed: Jun. 9, 1982

[51] Int. Cl.[3] ..... F15B 11/08; F15B 13/044

[52] U.S. Cl. ..... 91/420; 91/427; 91/448; 91/453; 91/465; 91/459

[58] Field of Search ..... 91/420, 427, 446, 448, 91/453, 459, 465; 49/28, 266, 265; 137/596.17, 102

[56] References Cited

U.S. PATENT DOCUMENTS

| | | | |
|---|---|---|---|
| 1,145,911 | 7/1915 | McElroy | 91/465 X |
| 2,485,252 | 10/1949 | Almond | 91/427 X |
| 3,026,676 | 3/1962 | Wenzel et al. | 91/420 X |
| 3,921,335 | 11/1975 | Hewitt et al. | 49/265 |
| 4,369,696 | 1/1983 | Klatt et al. | 91/465 |

FOREIGN PATENT DOCUMENTS 2926218 1/1981 Fed. Rep. of Germany .

*Primary Examiner*—Irwin C. Cohen
*Attorney, Agent, or Firm*—A. G. Williamson, Jr.

[57] ABSTRACT

Pressurization of closing and opening chambers of a door operator is controlled by first and second magnet valves coupled to the source of air. These valves are alternately energized by a switching network, e.g., a flip-flop, when sequentially actuated to close and open the door. The second magnet valve is biased to its vent position but the first valve is operated to its vent position by air through a double check valve when the second magnet valve is energized. Emergency and choke valves are inserted in series in the air supply to the magnet valves and normally pass air without restriction. Operation of the emergency valve, e.g., door blocked, shuts off air from the magnet valves and diverts that air to inhibit all output from the switching network and, through the check valve in opposite position, to operate the first magnet valve to vent position. Door operation is halted in position. Shortly the choke valve, because of the venting of both magnet valves, shifts from non-choke to choke position to restrict flow of air when the emergency valve is restored to normal. Restoration of door operation, by switch network actuation at the end of the emergency, is thus initially at a restricted rate.

2 Claims, 2 Drawing Figures

PNEUMATIC DOOR OPERATOR

FIELD AND BACKGROUND OF THE INVENTION

The invention concerns a pneumatic door operating device having an electro-pneumatic control, particularly suited for doors of vehicles used in public transportation.

Door operating devices are generally controlled pneumatically or electro-pneumatically, meaning that the driver releases a pneumatic or electrical impulse to open or close the door. This impulse, which travels over a control valve, also called a door valve, and actuates a door control cylinder, also called a door operator, with forced air, whereby the movements of the door cylinder piston effect the opening and closing movements of the door.

In such a system, it is generally required that the closing movements of a pneumatically operable vehicle door automatically convert to an opening movement when persons or objects become wedged in a closing door. Furthermore, the requirement exists that after the emergency valve has been activated and then reset for normal operation, no undesired door movements are present. A well-known pneumatic door operating device which meets the requirements has an emergency valve arrangement which consists of a valve combination of three 3/2 routing valves, namely, two magnet servo-valves and a pneumatic control valve. The door valve, which has been built into this unit, consists of a magnetically controlled 4/2 routing valve.

The object of the invention is to realize the described safety measures using fewer expensive valve devices.

SUMMARY OF THE INVENTION

The invention envisions a pneumatic door operating unit, in which the valve arrangement is so structured that both the normal functions of a door valve, as well as the emergency functions, are encompassed in one housing. All necessary measures have been designed into this pneumatic door operating unit which will protect passengers in the case of an emergency. Among others, these include the automatic opening of the door if a person should become caught in it or by any other activation of the emergency valve. After the door mechanism is depressurized by means of the emergency valve, repressurizing is prevented by a choke function until the choke valve is reset. By coupling simple 3/2 magnet-routing valves into a unified valve, both door operating methods can be secured without requiring other additional valve devices, i.e., with the help of control elements. Other basic functions inherent to the previously mentioned pneumatic door operating devices are achieved as well. At the same time, the unified valve favorably assumes the functions of a door valve.

BRIEF DESCRIPTION OF THE DRAWINGS

Before defining the invention in the appended claims, we will describe the apparatus and operation in a specific arrangement for door operation as shown in the accompanying drawings, in which:

In each of the drawing figures, the same references designate the same or similar parts of the apparatus.

DESCRIPTION OF THE ILLUSTRATED EMBODIMENT

Figure 1:
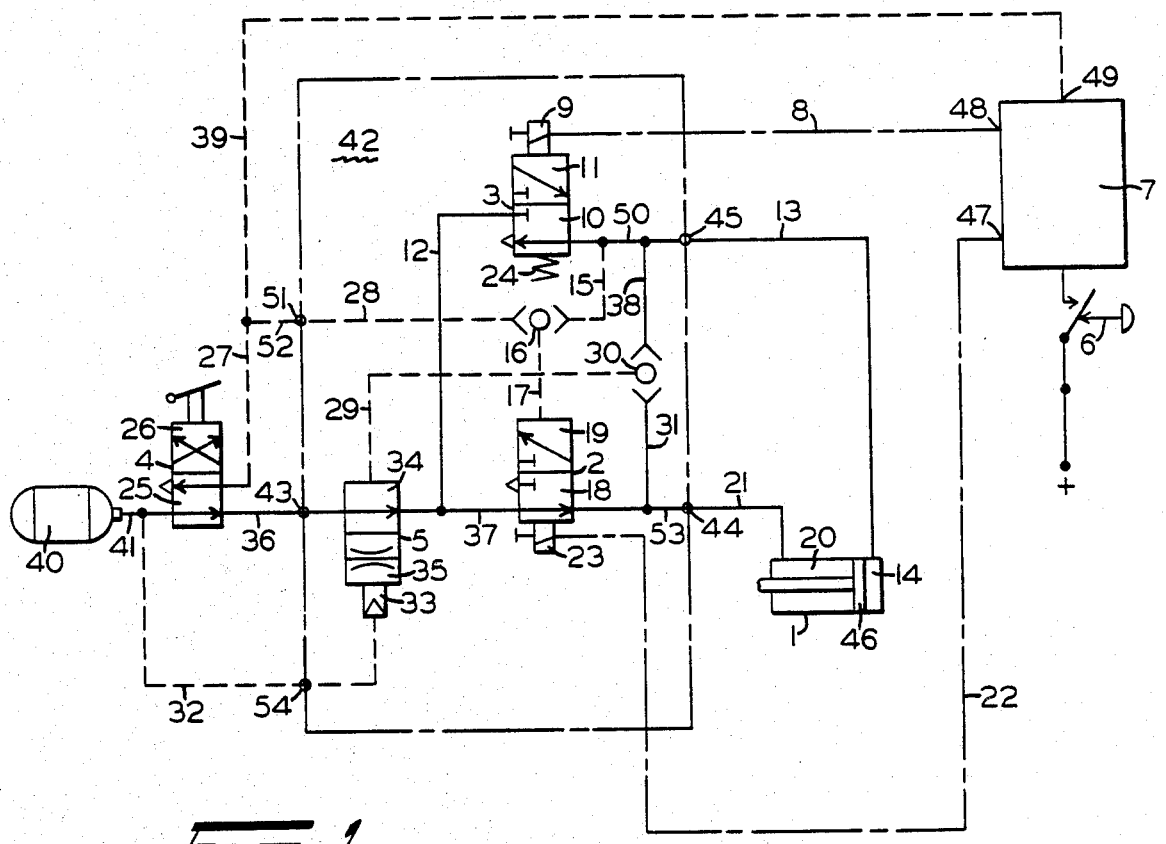
FIG. 1 is a schematic and diagrammatic illustration of one specific form of electropneumatic door operator embodying the invention.

The pneumatic door operating unit illustrated in FIG. 1 encompasses the storage container 40, which is connected by leads 41 and 36 to an emergency valve 4 and a controlled door valve 42 through its connection 43. The door valve 42 is connected to a door control device 1 by connections 44 and 45 and leads 21 and 13. In the embodiment described here, the door controller is shown as a double acting cylinder encompassing two chambers, a door opening chamber 14, and a door closing chamber 20, as well as a piston 46.

The door valve 42 includes two 3/2 magnet routing valves 2 and 3, a choke valve 5, and two double check valves 16 and 30, all of which are within a unit housing designated by the dot-dash block. The first 3/2 routing magnet valve 2, which has two positions 18 and 19 and an actuating magnet 23, as well as a pneumatic control connection 17, serves as the pneumatic control of the door closing chamber 20 of the door activating cylinder 1 through housing connection 44 and lead 21. The second 3/2 routing magnet valve 3 provides the pneumatic control for the door opening chamber 14 through housing connection 45 and lead 13. This valve has positions 10 and 11, a magnet 9, and a biasing spring 24. The movable element of this second magnet valve 3 is initially tensioned by the bias spring 24 in order to achieve a return necessitated for operation to a particular switch setting.

Figure 2:
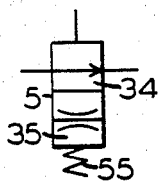
FIG. 2 illustrates schematically an alternate form of choke valve usable in the arrangement of FIG. 1.

To control the door valve 42, electrical wiring connections 22 and 8 exist between the electromagnets 23 and 9 of the 3/2 routing magnet valves 2 and 3, respectively, and the electrical output terminals 47 and 48 of an electropneumatic switching network 7, which is activated by means of a manually operable switch 6. Switching network 7, shown by a conventional block, is designed to shift its electrical output signal between terminals 47 and 48, i.e., to magnets 23 and 9, each time switch is activated, i.e., closed. A pneumatic input connection 49 of the switch network 7 is connected to the emergency valve by the leads 39 and 27. When air pressure is applied at terminal 49, both outputs of network 7 are inhibited. The choke valve 5 which is an integral part of door valve 42 has a free passage position 34 and a choke position 35. It is connected on the inlet side to the emergency valve 4 over connection 43 and lead 36 and is connected on the outlet side with the two magnet routing valves 2 and 3 over the stator bores 37, 12. The actuating device 33 of choke valve 5 is acted upon by the stored pressure of the container 40 over a lead 32 and a housing connection 54, as is shown in FIG. 1. As shown in FIG. 2, the use of a switch spring 55 in place of air pressure activated device 33 is an alternate method of controlling valve 5. Stator bores 15 and 17, through check valve 16 connect with bore 50, which leads to housing connection 45 and the first magnet routing valve 2. From the other position of valve 16, bore 28 connects with a housing connection 51, which is a connection for a lead 52, which provides a connection with leads 27 and 39 running from the emergency valve 4 to the pneumatic control connection 49 of the electropneumatic switch network 7.

The first double check valve 16 switches the stator bores 15, 28, and 17. This valve serves to complete the connection between the leads 15 and 17 in one switch position. In the other switch position, it establishes a connection between the leads 28 and 17. The second double check valve 30 in one position completes a connection over stator bores 29, 31, and 53 between the choke valve 5 and the connection 44 of the door closing chamber 20. In the other position, it provides a connection over the bores 29, 38, and 50, between the choke valve 5 and the connection 45 of the door opening chamber 14.

The operation of the pneumatic door operating unit illustrated in FIG. 1 is now described. The position of the symbols show the arrangement with the door closed, i.e., the door closing chamber 20 of the door cylinder 1 is pressurized over the emergency valve 4, the not-choked position 34 of choke valve 5 and position 18 of the first magnet valve 2 which has been set to permit passage. At the same time, the door opening chamber 14 is exhausted over the lead 13 and the second magnet valve 3 in position 10.

To open the door, the operating device 6 is activated and the switch network 7 transmits a continuing electrical impulse over lead 8 to magnet 9 of the second magnet valve 3. The magnet valve 3 switches from position 10 to position 11 and the stored air at connection 43 flows over choke valve 5 and bore 12 through the magnet valve 3, bore 50, and lead 13 into the opening chamber 14 of the door cylinder 1. At the same time, the stored air flows over bore 15, the double check valve 16, and bore 17 to the magnet valve 2, which effects a switching of the magnet valve 2 from position 18 to position 19. The closing chamber 20 is thereby vented over lead 21, bore 53, and magnet valve 2 into the atmosphere. With chamber 20 exhausted, the air pressure in chamber 14 actuates piston 46 to open the door. In order to close the door, the operating device 6 is again activated, shifting the switch network 7 to interrupt the continuing electrical impulse energizing magnet 9. The magnet valve 3, under the influence of spring 24, then returns to the exhaust position 10 shown. Thus bores 17, 15, and 50, as well as the door opening chamber 14, over lead 13 and bore 50, have no pressure. At the same time, the electropneumatic switch network 7 transmits an impulse over lead 22 to the magnet 23 of magnet valve 2 which returns to the position 18. Stored air can again flow over bore 53, connection 44, and lead 21 into the closing chamber 20 of the door cylinder 1. The door thus returns to the closed position.

If the emergency valve 4 is activated for some reason while the door is being closed, it moves from the pictured normal position 25 into the emergency position 26. Stored air then flows over lead 27, lead 52, connection 51, bore 28, double check valve 16, and bore 17 to the magnet valve 2, switching it into position 19. This exhausts the closing chamber 20 of the door cylinder 1, over bore 53 and lead 21, as well as the bore 29 leading to the choke valve 5 over double check valve 30 and bore 31. With bore 29 not pressurized, the choke valve 5 switches, due to the influence of the stored in-line pressure over lead 32 and connection 54 to controller 33 from the normal operating position 34 into the choke position 35. If the FIG. 2 alternate is used, valve 5 switches under the influence of spring 55.

If the emergency valve is switched back into its normal position, stored air can flow from lead 36 over the choke valve 5 which is switched into the choke position 35, into the bores 37 and 12. Magnet valve 2, which is in position 19, blocks further passage from bore 37 while magnet valve 3, in position 10, blocks bore 12. The door cylinder 1 thus is not pressurized during these actions since this can only be accomplished by activating the control mechanism 6 so that an impulse reaches one of the two magnets 23 or 9 of the magnet valves 2 and 3.

Pressurizing of cylinder 1 which occurs after the emergency valve 4 has been reset to its normal position is always choked, as the choke valve 5 is in its choke position 35. Not until a specific pressure is reached in the bore 29, which either corresponds over bore 31 with the pressure in the closing chamber 20 or over bore 38 to the pressure in the opening chamber 14, does the choke valve 5 switch into its normal position 34, due to overcoming the pressure at controller 33. After this has occurred, it allows unrestricted passage for all further pressurization.

If the emergency valve is switched from the normal position 25 into the emergency position 26 when the door is open, the stored air flows over the leads 27 and 39 to the electrical switch network 7 of connection 49, which interrupts the continuing impulse to the electromagnet 9. Thereby the magnet valve 3 switches from position 11 to position 10, which exhausts the opening chamber 14. At the same time, the pressure affecting the choke valve 5 over bore 29, the double check valve 30, and bore 38 drops to zero so that the choke valve 5 switches to the choke position 35 under the influence of the stored pressure applied at the control element 33.

Although there is herein shown and described but one specific arrangement of a pneumatic door operator embodying the invention, it is to be understood that changes and modifications therein within the scope of the appended claims are within the spirit and scope of the invention.

Having now described the invention, what we claim as new and desire to secure by Letters Patent, is:

1. An electropneumatic door control arrangement, for operating a door between first and second positions, and including a source of pressurized air, comprising, (a) a pneumatic door operator including first and second control chambers separated by a piston operable to a first and a second position as pressurized air is supplied to said first and second chambers, respectively, (b) piston coupling means for operating a door to first and second positions as said piston operates between said first and second positions, respectively, (c) a first and a second magnet valve, each having an electromagnet and a passage and a vent position and each in fluid communication with such pressurized air source, each valve is operable to the passage position when the associated electromagnet is energized, (d) valve biasing means for biasing said second valve to said vent position when deenergized, (e) manually controllable electrical switching means for alternately energizing said first and second magnet valve when operated sequentially at selected times between first and second conditions, respectively, (f) said first magnet valve further in fluid communication with said door operator such that, when in said passage position, pressurized air is communicated to said first chamber, and when in said vent position, air is exhausted from said first chamber, (g) said second magnet valve further in fluid communication with said door operator such that pressurized air is communicated to said second chamber and air is exhausted from said second chamber when said second magnet valve is energized or deenergized, respectively, (h) said second magnet valve also in fluid communication with said first magnet valve such that, when said second magnet valve is energized, pressurized air is communicated to said first magnet valve to operate said first magnet valve to said vent position, (i) a two position emergency valve in fluid communication with the air supply from such source, normally occupying a passage position so that pressurized air is communicated to both magnet valves, and when in the other emergency position, the supply of air is blocked from such source to both magnet valves and pressurized air is communicated to said switching means to inhibit energization of either magnet valve and to operate said first magnet valve to said vent position, and (j) a two position choke valve connected between said emergency valve and said magnet valves, having a choke position and a normal non-choke position wherein pressurized air is freely communicated to said magnet valves, and (k) choke operating means for responding to the blockage of air to both magnet valves with said emergency valve in its emergency position, said choke operating means operating said choke valve to its choke position for initially restricting the supply of air to said magnet valves when said emergency valve returns to its passage position, and for returning said choke valve to said non-choke position when a predetermined pressurized air value has been communicated through one of said magnet valves.

2. A door control arrangement as defined in claim 1 which further includes, (a) a first double check valve connected to said first and second magnet valves such that, when said second magnet valve is energized, said first double check valve opens in one direction and pressurized air is supplied to operate said first magnet valve to its vent position, and (b) a second double check valve in fluid communication with both magnet valves and said choke operating means such that pressurized air retains said choke valve in its non-choke position, and in which, (c) said first double check valve is also coupled to said emergency valve when said first double choke valve opens in another direction for passing air to operate said first magnet valve to its vent position when said emergency valve is in its emergency position, and (d) said choke operating means includes a connection to said source for receiving air to operate said choke valve to its choke position in the absence of retaining air pressure from said magnet valves.

* * * * *